US005937236A

United States Patent [19]

Kim

[11] Patent Number: 5,937,236

[45] Date of Patent: Aug. 10, 1999

[54] GHOST-IMAGE PREVENTING APPARATUS FOR A DEVELOPING ROLLER

[75] Inventor: Soon-Nam Kim, Suwon, Rep. of Korea

[73] Assignee: SamSung Electronics Co., Ltd., Kyungki-do, Rep. of Korea

[21] Appl. No.: 08/928,067

[22] Filed: Sep. 11, 1997

[30] Foreign Application Priority Data

Sep. 11, 1996 [KR] Rep. of Korea ..... 1996-39385

[51] Int. Cl.[6] ..... G03G 15/08

[52] U.S. Cl. ..... 399/103; 399/283

[58] Field of Search ..... 399/103, 104, 399/105, 283, 273, 279, 281, 284, 285

[56] References Cited

U.S. PATENT DOCUMENTS

| | | | |
|---|---|---|---|
| 3,152,012 | 10/1964 | Schaffert . | |
| 3,731,146 | 5/1973 | Bettiga et al. . | |
| 3,893,418 | 7/1975 | Liebman et al. . | |
| 3,929,098 | 12/1975 | Liebman . | |
| 4,406,536 | 9/1983 | Suzuki et al. . | |
| 4,745,429 | 5/1988 | Mukai et al. | 399/283 |
| 4,806,992 | 2/1989 | Yasuda et al. . | |
| 4,930,438 | 6/1990 | Demizu et al. . | |
| 5,076,201 | 12/1991 | Nishio et al. . | |
| 5,095,341 | 3/1992 | Yoshida et al. . | |
| 5,111,246 | 5/1992 | Brailsford et al. . | |
| 5,132,734 | 7/1992 | Momiyama et al. . | |
| 5,146,285 | 9/1992 | Kikuchi et al. . | |
| 5,166,472 | 11/1992 | Maeda et al. . | |
| 5,177,323 | 1/1993 | Kohyama . | |
| 5,177,537 | 1/1993 | Okano et al. . | |
| 5,210,551 | 5/1993 | Inoue et al. . | |
| 5,249,025 | 9/1993 | Nakazawa et al. . | |
| 5,311,258 | 5/1994 | Brewington et al. . | |
| 5,317,370 | 5/1994 | Kohyama et al. . | |
| 5,379,097 | 1/1995 | Aoto et al. . | |
| 5,477,006 | 12/1995 | Imamiya et al. | 399/285 |
| 5,568,236 | 10/1996 | Toda et al. | 399/285 |
| 5,604,573 | 2/1997 | Endo et al. . | |
| 5,708,921 | 1/1998 | Yogi et al. | 399/98 |

FOREIGN PATENT DOCUMENTS 63-96678 4/1988 Japan .

OTHER PUBLICATIONS

Patent Abstracts of Japan vol. 095, No. 007, Aug. 31, 1995 &JP 07 110622a (Seiko Epson Corp), Apr. 25, 1995.

Patent Abstracts of Japan vol. 096, No. 009, Sep. 30, 1996 &JP 08 137257 A (Minolta Co Ltd. May 31, 1996.

*Primary Examiner*—Joan Pendegrass

*Attorney, Agent, or Firm*—Robert E. Bushnell, Esq.

[57] ABSTRACT

The ghost-image preventing apparatus including a grounded seal installed on a developing frame that prevents toner from flowing to the developing roller and neutralizes the charge of toner remaining on the developing roller. Another embodiment induces a voltage across the seal of the same magnitude as, but having opposite polarity to, the charge of the developing roller to neutralize the electric charge of the toner remaining on the surface of the developing roller after an electrostatic latent image or a photosensitive drum is developed.

9 Claims, 2 Drawing Sheets

GHOST-IMAGE PREVENTING APPARATUS FOR A DEVELOPING ROLLER

CLAIM OF PRIORITY

This application makes reference to, incorporates the same herein, and claims all benefits accruing under 35 U.S.C. §119 from an application entitled Ghost Preventing Apparatus of Developing Roller earlier filed in the Korean Industrial Property Office on Sep. 11, 1996, and there duly assigned Ser. No. 96-39385 by that Office.

BACKGROUND OF THE INVENTION

1. Field of the Invention

The present invention relates to a developing unit of an electrophotographic processor, such as a laser printer, copier or plain paper facsimile. More particularly, the present invention relates to an apparatus which eliminates the electric charge of toner remaining on the surface of a developing roller.

2. Description of Background Art

Generally, a printer using an electrophotographic developing system includes a photosensitive drum on which a latent image is formed conductively when exposed to light. A charge roller supplies a high voltage to the photosensitive drum. An exposing unit irradiates a prescribed portion of the photosensitive drum to light energy corresponding to a character signal or an image signal transmitted from a computer. A developing roller adheres charged toner on the photosensitive drum. A transfer unit transfers the toner from the photosensitive drum onto a recording sheet with a high voltage differential. A fixing unit fixes the toner on the recording sheet with high voltage and pressure.

Exemplars of contemporary practice in the art include U.S. Pat. No. 5,604,573 for Developing Unit with a Smoothing Plate, issued to Endo et al., which a developing sleeve on which is superimposed a bias voltage. The device also includes a linear electrode member also having a bias voltage imposed thereon, with an assertion that it is preferable from a view point of toner adhering prevention that a DC voltage having the same polarity as that of the toner be impressed upon the linear electrode member 84." The DC voltage impressed upon the sleeve may be equal to the DC voltage impressed upon the linear electrode member.

U.S. Pat. No. 5,177,537 for Developing Apparatus with Elastic Regulating Member Urged to a Developer Carrying Member, issued to Okano et al., includes an elastic blade in contact with the developing sleeve. The elastic blade is coated with resin particles electrically chargeable to a positive polaity. The elastic blade is charged via friction with the toner particles on the developing roller. U.S. Pat. No. 4,806,992 for Developing Apparatus, issued to Yasuda et al., includes a developer supply roller with a grounded shaft. The supply roller has an electrostatically-induced negative charge which attracts positively-charged toner.

U.S. Pat. No. 4,930,438 for Developing Device Using a Single Component Developer, issued to Demizu et al., includes a discharging brush downstream of the developing station. The discharging brush is electrically connected to the bias voltage source so that a potential is maintained at the same level as that of the electrically-conductive support of the developing sleeve. U.S. Pat. No. 5,076,201 for Developing Device Used in Electrophotographic Field And Method of Producing Developing Roller Incorporated Therein, issued to Nishio et al., includes a blade member that contacts the developing roller. The blade member has a bias voltage applied across it so that charged toner particles are prevented from being electrostatically adhered to the blade member 20.

I have found that the toner remaining on the surface of the developing roller, after the electrostatic latent image formed on the surface of the photosensitive drum is developed, exhibits a strong negative charge and presents a ghost image which contaminates the next-forming image.

SUMMARY OF THE INVENTION

An object of the present invention is to provide an improved image forming process and apparatus.

It is another object to provide a ghost-preventing apparatus that discourages the continued presence of residual, or ghost images from remaining on a developing roller.

It is still another object is to provide a ghost-preventing apparatus that eliminates the electric charge of toner remaining on the surface of a developing roller.

It is yet object is to provide a ghost-preventing process and apparatus that completely cleans toner from the surface of a developing roller.

It is still yet another object to provide a ghost preventing apparatus which can completely clean a toner of a negative charge remaining on the surface of a developing roller from a supply roller.

It is a further object to provide a ghost-preventing process and apparatus for a developing roller facilitating formation and transfer of high-resolution images.

In accordance with one aspect of the present invention, a ghost preventing apparatus is constructed in a developing unit of an electrophotographic processor having a developing roller for developing an electrostatic latent image and a supply roller for supplying a toner agitated by an agitator to the developing roller. A seal is installed at the inner side of a developing frame to prevent a toner from flowing between the developing roller and the developing frame. The seal is electrically grounded to eliminate an electric charge of the toner remaining on the surface of the developing roller after the electrostatic latent image of the photosensitive drum is developed to the toner image.

In accordance with another aspect of the present invention, a ghost preventing apparatus is constructed in a developing unit of an electrophotographic processor having a developing roller for developing an electrostatic latent image formed on the surface of a photosensitive drum to a toner image and a supply roller for supplying a toner agitated by an agitator to the developing roller. A seal of conductive thin plate material is installed at the inner side of a developing frame to prevent the toner from flowing between the developing roller and the developing frame. A constant voltage is applied from a voltage supplier to the seal in order to eliminate an electric charge of the toner remaining on the surface of the developing roller after the electrostatic latent image of the photosensitive drum is developed to the toner image. The present invention is more specifically described in the following paragraphs by reference to the drawings attached only by way of example.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
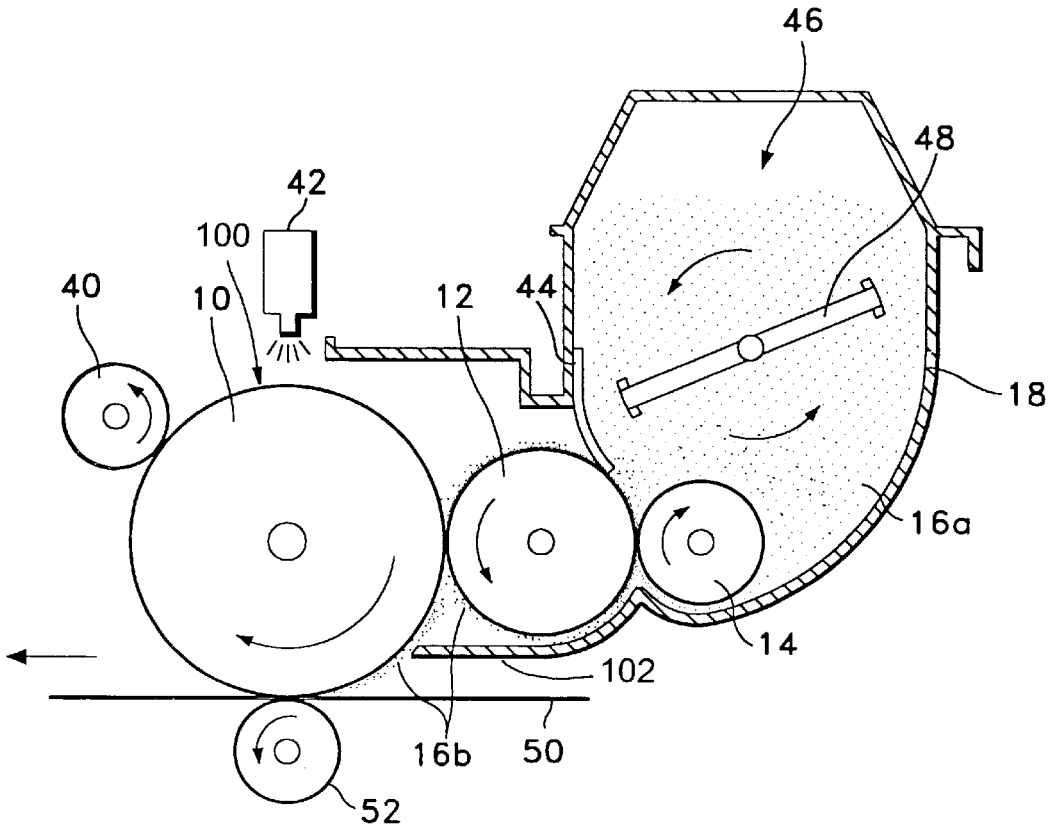
FIG. 1 is a schematic cross-sectional diagram of an electrophotographic processor in an image forming apparatus.

FIG. 1 is a schematic diagram of an image-forming apparatus of an electrophotographic processor. In a printing process, toner 16*a*, supplied to a toner stacker 46, is agitated by an agitator 48, and static electricity from friction between the particles of toner 16*a*. The toner 16*a* assumes a constant electric charge is generated. The agitated toner 16*a* is conveyed to a supply roller 14 by the rotation of the agitator 48 and transferred to a developing roller 12. The toner 16*b* on the surface of the developing roller 12 is restricted to a uniform height by a doctor blade 44.

The surface of a photosensitive drum 10 is uniformly charged to a negative polarity by a charge roller 40. A portion 100 of the photosensitive drum 10 is exposed to light irradiated by an exposing unit 42 corresponding to an electronic image signal received from a controller (not shown). The portion of the exterior cumferential surface of the drum 10 exposed to the light forms an electrostatic latent image. The electrostatic latent image exhibits negligible charge characteristics as compared with the unexposed circumferential surface of the photosensitive drum 10. Toner deposition on the latent image defines a toner image.

A recording sheet 50 is fed toward a transfer roller 52. The toner image on the surface of the photosensitive drum 10 is transferred onto the recording sheet 50 as a result of the high voltage of the transfer roller 52 relative to the photosensitive drum 10. The recording sheet 50 passes between heat and pressure rollers of a fixing unit (not shown) where the transferred image is fixed.

Figure 2:
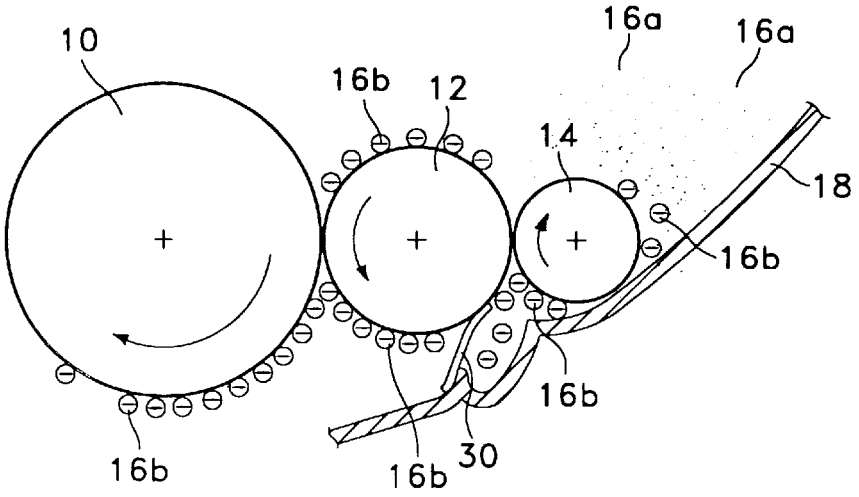
FIG. 2 is a schematic cross-sectional diagram of a developing unit in an image forming apparatus.

Referring to FIG. 2, a developing roller 12 is installed at one side of the photosensitive drum 10. The supply roller 14 is installed on the other side of the developing roller 12. A seal 30 of in, urethane rubber material is fixed to the developing frame 18 in order to prevent toner 16*a* from flowing to the developing roller 12. One side of the seal 30 is in contact with the surface of the developing roller 12.

While the photosensitive drum 10 rotates clockwise, it is covered with toner 16*b* having a strong negative charge. Unfortunately, some of the toner 16*b* that should have been transferred to photosensitive drum remains on the surface of the developing roller 12. Furthermore, only a portion of this remaining toner 16*b* is returned to the toner stacker 46. This residual toner remaining on the surface of the developing roller after the electrostatic latent image formed on the surface of the photosensitive drum is converted into a visual image exhibits a strong, negatively-charged ghost image which contaminates the next-forming image.

Figure 3:
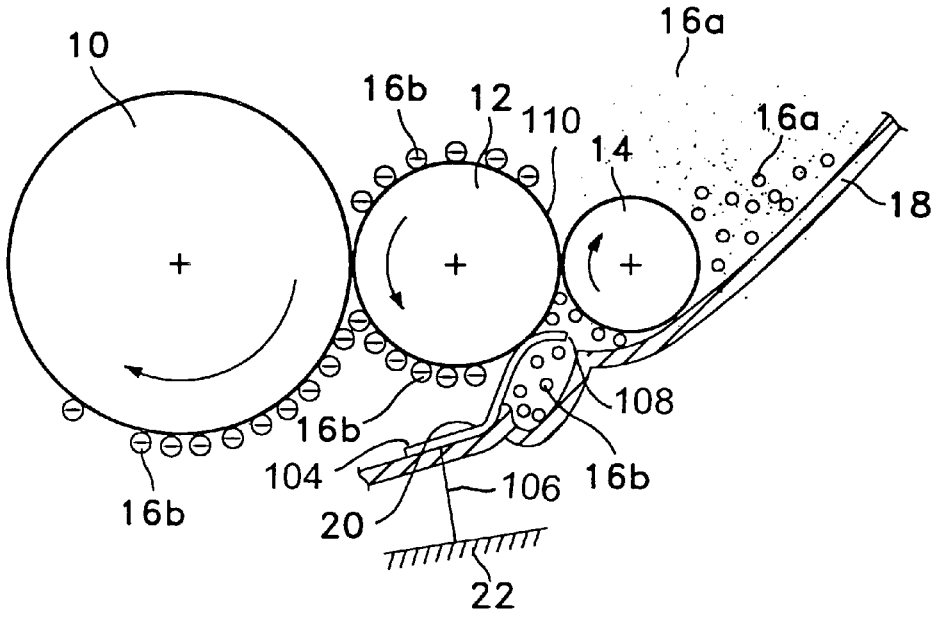
FIG. 3 is a schematic cross-sectional diagram of a developing unit constructed according to the principles of the present invention.

Refer now to FIG. 3, which illustrates a schematic cross-sectional diagram of a developing unit constructed according to the principles of the present invention. The seal 20, constructed from conductive, thin plate material, is fixed to the inner bottom of a developing frame 18, preventing toner 16*a* from flowing to the developing roller 12. The developing frame 18 may be comprised of a conductive material, a non-conductive material, or a combination of the two types of material. The seal 20 may be fixed to the frame 18 by a screw, weldment or like means. The end 108 of the seal 20 is in contact with the surface 110 of the developing roller 12. The other end 104 of the seal 20 is coupled to the frame 18. In addition, the end 104 of the seal 20 is grounded with an electrically conducting lead 106. The lead 106 may correspond to a single lead or to a plurality of leads. The grounder 106 removes the negative charge of the toner 16*b* remaining on the surface of the developing roller 12 after the developing roller 12 develops the electrostatic latent image formed on the surface of the photosensitive drum 10. The negative charge of the toner 16*b* remaining on the surface of the developing roller 12 flows through the seal 20 to a ground terminal 22. The charge of the toner 16*b* essentially drops to zero.

Figure 4:
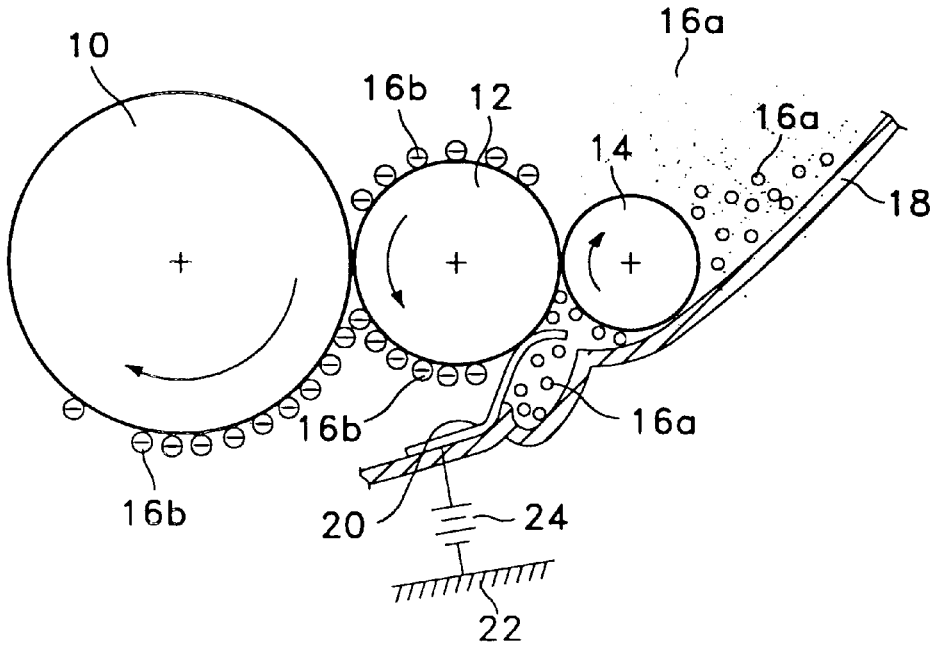
FIG. 4 is a schematic cross-sectional diagram of a developing unit constructed as another embodiment of the principles of the present invention.

Referring to FIG. 4, another embodiment of the invention provides a seal 20 connected to a voltage supply 24. The voltage supply 24 supplies a constant positive voltage to the seal 20 with an absolute value commensurate with the absolute value of the negative potential of the toner 16*b* remaining on the surface of the developing roller 12. The positive charge of the seal 20 cancels the negative charge of the toner remaining on the developing roller 12. The voltage supply 24 supplies a voltage of about 5–100 volts to the seal 20. If the toner remaining on the surface of the developing roller 12 has a positive charge, the voltage supplier 24 supplies a negative voltage to the seal 20 so as to neutralize the toner charge.

The foregoing paragraphs describe an image forming apparatus constituted with a seal installed at the inner side of a developing frame that prevents toner from flowing from the toner stacker to the developing roller. The seal is electrically connected to eliminate the electric charge of the toner remaining on the surface of the developing roller after the electrostatic latent image of the photosensitive drum is developed into a toner image. The seal, constructed from conductive, thin plate material, may have a constant voltage applied to it to eliminate the electric charge of the toner remaining on the surface of the developing roller after the electrostatic latent image of the photosensitive drum is developed.

The present invention is not limited to the particular embodiments disclosed herein, but encompasses all embodiments within the appended claims. While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A ghost preventing image forming apparatus, comprising:

a developing unit of an electrophotographic processor including a developing roller developing an electrostatic latent image formed on an exterior surface of a photosensitive drum into a toner image, an agitator, and a supply roller supplying toner agitated by said agitator to said developing roller;

a frame made of an electrically conducting material supporting said developing unit;

a seal installed at an inner side of said frame preventing the toner from flowing between said developing roller and said frame, said seal being electrically connected to a reference voltage discharging an electric charge of the toner remaining on a surface of said developing roller after the electrostatic latent image of said photosensitive drum is developed into the toner image; and said reference voltage having an absolute value ranging from 5 to 100 volts.

2. A ghost preventing image forming apparatus, comprising:

a developing unit of an electrophotographic processor including a developing roller developing an electrostatic latent image formed on an exterior surface of a photosensitive drum into a toner image, an agitator, and a supply roller supplying toner agitated by said agitator to said developing roller;

a frame made of an electrically conducting material supporting said developing unit;

a seal installed at an inner side of said frame preventing the toner from flowing between said developing roller and said frame, said seal being electrically connected to a reference potential discharging an electric charge of the toner remaining on a surface of said developing roller after the electrostatic latent image of said photosensitive drum is developed into the toner image; and said frame providing said reference potential, and a lead coupling said seal to said frame.

3. A ghost preventing image forming apparatus, comprising:

a developing unit of an electrophotographic processor including a developing roller developing an electrostatic latent image formed on an exterior surface of a photosensitive drum into a toner image, an agitator, and a supply roller supplying toner agitated by said agitator to said developing roller;

a frame supporting said developing unit within said image forming apparatus;

a seal of conductive thin plate material installed at an inner side of said frame preventing the toner from flowing between said developing roller and said frame;

an electrical lead coupling said seal to a reference voltage; and a voltage supplier coupled to said seal and the reference voltage, wherein said voltage supplier supplies a voltage to said electrical lead, and said voltage supplier enables said lead and said seal to have a charge opposite to the electric charge of said toner in order to approximate the electric charge of the toner remaining on the surface of said developing roller to "0", wherein said voltage supplier supplies a voltage to said lead, enabling said seal of conductive thin plate material to have a positive charge, and wherein said electrical lead supplies a voltage having a magnitude between five and one hundred volts to said seal.

4. A ghost preventing image forming apparatus, comprising:

a developing unit of an electrophotographic processor including a developing roller developing an electrostatic latent image formed on an exterior surface of a photosensitive drum into a toner image, an agitator, and a supply roller supplying toner agitated by said agitator to said developing roller;

a frame supporting said developing unit within said image forming apparatus;

a seal of conductive thin plate material installed at an inner side of said frame preventing the toner from flowing between said developing roller and said frame; and an electrical lead coupling said seal to a reference voltage, wherein said reference voltage has an absolute value ranging from 5 to 100 volts.

5. A method eliminating ghost images in an image forming device, comprising the steps of:

contacting a surface of a developing roller of an image forming device with a photosensitive drum, said photosensitive drum having an exterior surface with an electrostatic latent image formed on said exterior surface; thereafter contacting the surface of said developing roller with a seal, said seal being coupled to a frame, and said frame being coupled to a reference voltage; and thereafter providing toner to the surface of said developing roller, the toner being agitated by an agitator and supplied by a supply roller prior to being provided to the surface of said developing roller; and said seal discharging an electric charge of toner remaining on the surface of said developing roller after the electrostatic latent image of said photosensitive drum is developed into a toner image, and said seal allowing the toner remaining on the surface of said developing roller to be separated from the surface of said developing roller.

6. The method of claim 5, wherein said frame supports said seal.

7. The method of claim 5, further comprising the step of inducing a voltage between said seal and said frame.

8. The method of claim 7, wherein said voltage induced between said seal and said frame exhibits a polarity opposite to a polarity exhibited by the toner disposed on the surface of said developing roller.

9. The method of claim 7, wherein said voltage induced between said seal and said frame has an absolute value ranging from 5 to 100 volts.

* * * * *